US006270877B1

(12) United States Patent
Sloot

(10) Patent No.: US 6,270,877 B1
(45) Date of Patent: Aug. 7, 2001

(54) APPLIQUÉS FOR GARMENTS AND METHODS FOR MAKING SAME

(75) Inventor: Alexander Sloot, Sugarloaf, PA (US)

(73) Assignee: Printmark Industries, Inc., Hazleton, PA (US)

( * ) Notice: Subject to any disclaimer, the term of this patent is extended or adjusted under 35 U.S.C. 154(b) by 0 days.

(21) Appl. No.: 09/169,049

(22) Filed: Oct. 9, 1998

(51) Int. Cl.[7] ..... B32B 23/02

(52) U.S. Cl. ..... 428/192; 428/195; 428/194; 428/201; 24/1

(58) Field of Search ..... 428/195, 192, 428/194, 201, 913; 264/239; 24/1

(56) References Cited

U.S. PATENT DOCUMENTS

| | | | | |
|---|---|---|---|---|
| 3,379,604 | | 4/1968 | Weber et al. | 161/38 |
| 3,956,552 | | 5/1976 | Geary | 428/88 |
| 5,047,103 | | 9/1991 | Abrams et al. | 156/72 |
| 5,241,919 | | 9/1993 | LaGreca | 112/410 |
| 5,251,337 | * | 10/1993 | Sloot | 2/243.1 |
| 5,346,746 | * | 9/1994 | Abrams | 428/195 |
| 5,622,587 | | 4/1997 | Barthelman | 156/251 |
| 5,665,458 | | 9/1997 | Mahn, Jr. | 428/202 |
| 5,729,834 | * | 3/1998 | Sloot | 2/243.1 |
| 5,858,156 | * | 1/1999 | Abrams et al. | 156/230 |

* cited by examiner

*Primary Examiner*—Bruce H. Hess
*Assistant Examiner*—B. Shewareged
(74) *Attorney, Agent, or Firm*—St. Onge Steward Johnston & Reens, L

(57) ABSTRACT

An applique is provided for applying to garments, and the like and other substrates for decorative effect comprising a decoratively shaped perimeter and relief pattern, a plush layer having a pre-cut periphery, and a vinyl overlay encapsulating the periphery of the pre-cut plush layer. A method for making an applique having the above characteristics is also provided utilizing a differential height die.

11 Claims, 3 Drawing Sheets

APPLIQUÉS FOR GARMENTS AND METHODS FOR MAKING SAME

FIELD OF THE INVENTION

An applique with a plush layer having a pre-cut periphery, a vinyl overlay encapsulating the outer periphery of the plush layer, and at least one vinyl overlay within the peripheral vinyl overlay disposed on the plush layer. The vinyl layer may have decorative texturing or printing and a foam layer may be provided between the vinyl overlay and the plush layer or a backing layer. The applique may be provided on a garment, such as a t-shirt, sweatshirt or hat, or may be provided with a heat-activated backing layer for later application to a garment. A method for making the appliques using a die having an outer cutting and sealing edge that is lower than an inner, complementary cutting and sealing edge is also provided.

BACKGROUND OF THE INVENTION

Vinyl and fabric appliques for garments are well-known in the art. Plush fabric or flocked materials that are backed with pressure-sensitive adhesive, or that may be heat applied, are known in the art. Pre-cut laminated articles are known. Appliques having a decoratively shaped perimeter and relief pattern, a continuous vinyl overlay and/or a foam or plush intermediate or top layer are known. It is understood that "continuous" means a sheet or layer of material without portions removed or cut out of the sheet or layer so as to expose the layer below.

Articles having a continuous plush, fabric, flocked or vinyl top layer with or without plush, flock or foam layer encapsulated by the top layer and a relief pattern or other decorative or embossed design and/or decoratively shaped perimeters are known. It is understood that "encapsulated" means to cover and secure a layer with another layer.

Composite decals having plurality of continuous top layers covering decal supports or foam having an arcuate edge and adhered to a substrate are known. See U.S. Pat. No. 5,622,587 to Barthelman.

Appliques having a smooth flocked upper surface in a decorative pattern are known. See U.S. Pat. No. 5,047,103 to Abrams et al., and U.S. Pat. No. 3,956,552 to Geary. Flocked appliques having smooth flocked upper surfaces and cut lines in the decorative shapes desired are known. See U.S. Pat. No. 5,665,458 to Mahn.

U.S. Pat. No. 5,241,919 to LaGreca discloses appliques having pre-cut chenille, a vinyl backing layer, a fabric base, a water-soluble, continuous polymer overlay film, and stitching at the edge of the pre-cut chenille through the water-soluble overlay. LaGreca does not disclose or suggest a discontinuous vinyl overlay, seals corresponding to the perimeter of the pre-cut layer, peripheral and inner vinyl overlays, or a vinyl overlay that is printed, textured or otherwise provided with a decorative surface.

U.S. Pat. No. 3,379,604 to Weber et al. discloses a coating of adhesive having the desired decorative shape with flocking applied thereto and sandwiched between a release sheet having a film coating and a carrier sheet made of an open mesh material. Weber does not disclose or suggest a pre-cut plush fabric material, a vinyl overlay of any kind, much less a vinyl overlay encapsulating the periphery of a plush layer or at least one vinyl overlay within the peripheral vinyl overlay.

What is desired, therefore, is an applique that has both plush and smooth vinyl surfaces so as to form a discontinuous vinyl overlay, a decoratively shaped perimeter and relief pattern that can be produced economically.

SUMMARY OF THE INVENTION

Accordingly, it is an object of this disclosure to provide an applique having a decoratively shaped perimeter and relief pattern, that is comprised of a pre-cut plush layer and a vinyl overlay which is relatively simple and economical to manufacture.

Another object of this disclosure is to provide an applique having the above characteristics and which has decorative printing.

A further object of the above invention is to provide an applique having a peripheral vinyl overlay encapsulating a pre-cut plush layer and at least one inner vinyl overlay.

Still yet another object of the present disclosure is to provide an applique wherein the peripheral vinyl overlay has a lower die cut edge and seal, and a higher inner die cut edge and seal.

Yet another object of the present disclosure is to provide a method for making an applique having the above characteristics using a die having a relief pattern and a decoratively shaped cutting and sealing edges and an outer cutting and sealing edge that is lower than an inner, complementary cutting sealing edge so as to encapsulate the periphery of a pre-cut plush layer.

The invention and its particular features will become more apparent from the following detailed description considered with reference to the accompanying drawings.

BRIEF DESCRIPTION OF THE INVENTION

DETAILED DESCRIPTION OF THE INVENTION

Figure 1:
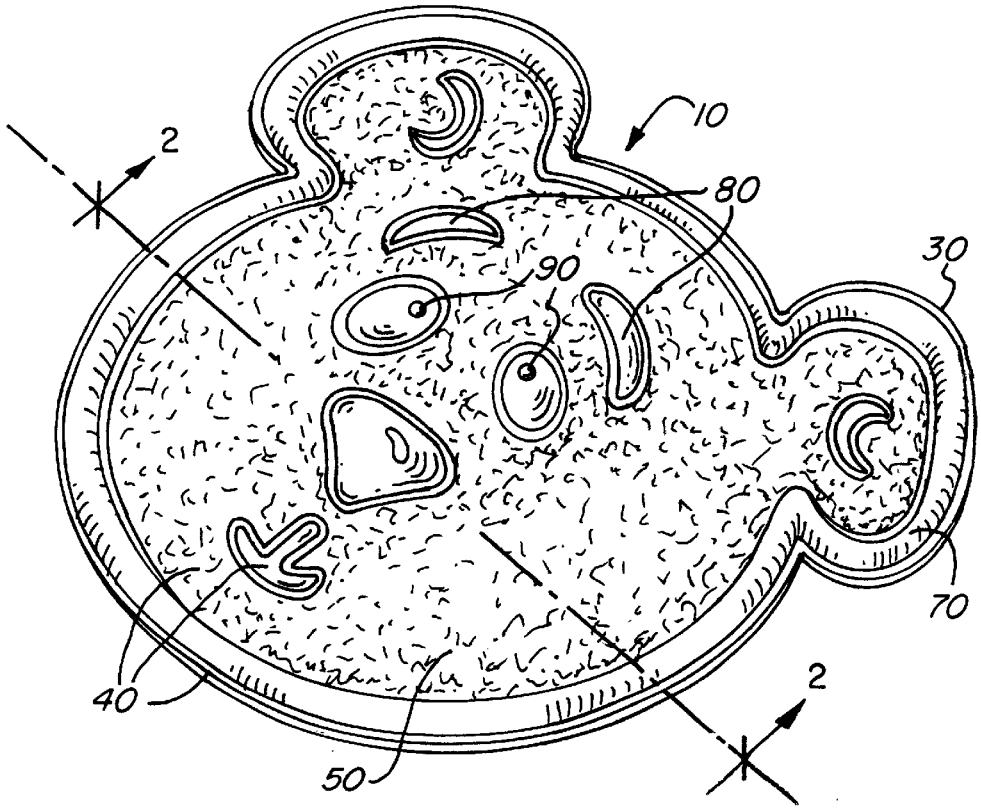
FIG. 1 is a perspective view of an applique for garments.

FIG. 1 depicts an applique 10 for applying to garments 20, including t-shirts, sweatshirts, or hats and the like. It is understood that the applique 10 may also be applied to other substrates, such as materials for use in automobile interiors, shoes, storage bags and luggage.

Applique 10 includes a decoratively shaped perimeter 30 and relief pattern 40. As shown in FIG. 1, applique 10 has a perimeter 30 and relief pattern 40 in the design of a teddy bear. It is understood, however, that decoratively shaped perimeter 30 and relief pattern 40 can be any shape and design.

The applique 10 has a plush layer 50 that has a periphery 60 that is cut with a die to a shape complementary with, yet slightly smaller than, the decoratively shaped perimeter 30 of the applique 10. The applique 10 also has a vinyl overlay 70 that encapsulates the periphery 60 of the pre-cut plush layer 50, and at least one vinyl overlay 80 within the peripheral vinyl overlay 70. In this case, the inner vinyl overlays 80 provide facial features for the bear design of the applique 10 shown in FIG. 1, and the plush layer 50 substantially surrounds the inner vinyl overlays 80. It is understood that the number of inner vinyl overlays 80 will be determined by the decorative shape and pattern desired for the applique 10.

The plush layer 50 is a nonwoven synthetic fabric having a plush and/or bulky appearance, such as that typically used as the outer material for stuffed animals. Plush layer 50 may also be a knitted fabric, a woven fabric or a woven or fabric-backed flocked material or flocked vinyl.

Decorative printing or texturing 90 may be provided on the vinyl overlays 70, 80 so as to provide additional decoration complementary with the decoratively shaped perimeter 30 and relief pattern 40 of the applique. As shown in FIG. 1, for example, the eyes of the bear may include black printing and white printing.

It is preferred, but not required that a vinyl backing layer 100 be used between the plush layer 50 and the garment 20, or heat-activated backing layer 110. More than one vinyl backing layer 100 may be used. The preferred thickness of the vinyl backing layer 100 ranges from about 0.005 inches to about 0.020 inches, depending upon the thickness of the pre-cut plush fabric.

Figure 2:
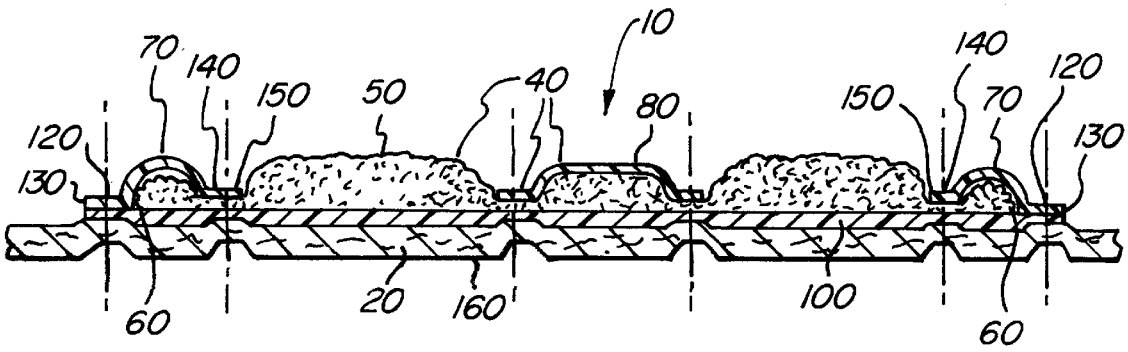
FIG. 2 is a cross-section of the applique of FIG. 1 at section line 2—2.

FIG. 2 illustrates the construction of one embodiment of the applique 10 applied to a garment 20. The applique 10 has a lower peripheral seal 120 and seal-cut edge 130 adjacent to the decoratively shaped perimeter 30 of the applique 10, and a higher inner seal 140 and seal-cut edge 150 adjacent the plush layer 50. As shown in FIG. 2, the lower peripheral seal 120 and seal-cut edge 130 does not seal the plush layer 50. The higher inner seal 140 seals through the plush layer 50 to the vinyl backing layer 100, preferred, and the garment 20. The higher inner seal-cut edge 150 cuts only the vinyl overlay 70 and not the plush layer 50 adjacent to the higher inner seal 140. Thus, the peripheral vinyl overlay 70 encapsulates the periphery 60 of the plush layer 50. Preferably the sealing is through all the layers of the applique so as to result in a strong bond to the garment 20 or other substrate. As indicated in FIG. 2, the peripheral and inner seals 120, 140 fuse all layers together and are preferably detectable on the back side 160 of the garment 20 or other substrate.

Figure 3:
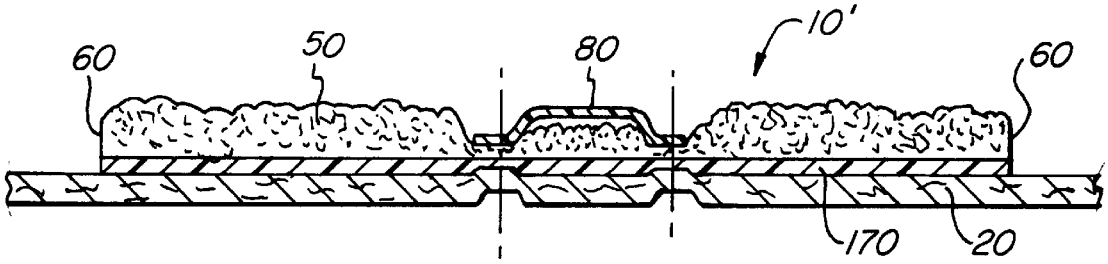
FIG. 3 depicts a cross-section of an alternate embodiment of the applique in accordance with this disclosure.

As shown in FIG. 3, an applique 10' may be made using a pre-cut plush layer 50 with a heat activated intermediate layer 170. The plush layer 50 and the heat activated layer 170 are applied to a garment 20, preferably with a bottom heat sealing machine. The inner vinyl overlay 80 is radio-frequency sealed to the plush layer 50. It can be seen that this embodiment does not require a peripheral vinyl overlay 70, although it may be desired for certain decorative effects. The use of a heat-activated intermediate layer 170 is preferred for all embodiments, including those with a peripheral vinyl overlay, but is not required.

Figure 4:
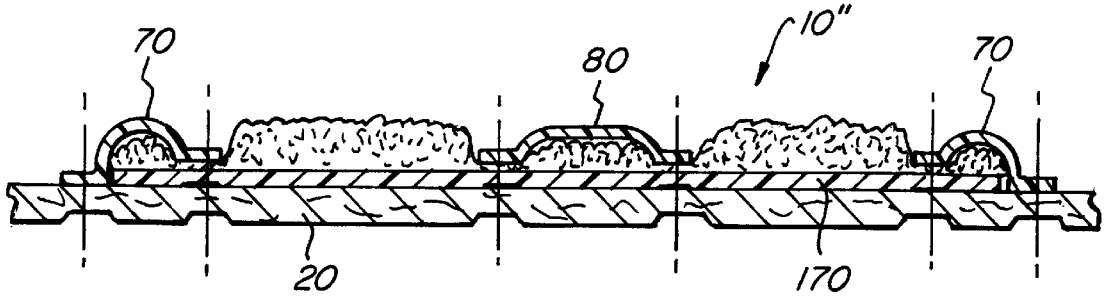
FIG. 4 is a cross-section of an alternate embodiment of the applique in accordance with this disclosure.

FIG. 4 shows an applique 10" having a heat activated intermediate layer 170 applied to a garment 20, as in FIG. 3, but having a peripheral vinyl overlay 70, in addition to the inner vinyl overlay 80.

Figure 5:
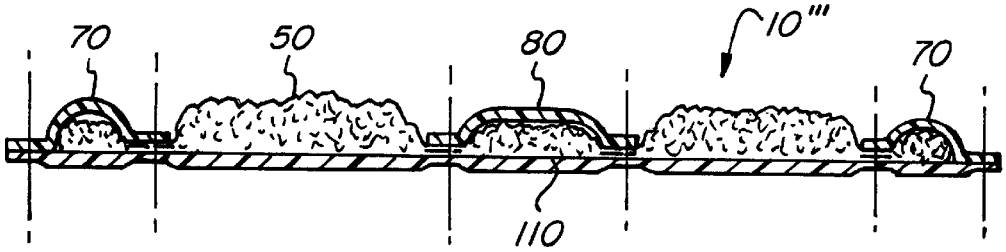
FIG. 5 is a cross-section of an alternate embodiment of the applique of FIG. 1.
Figure 6:
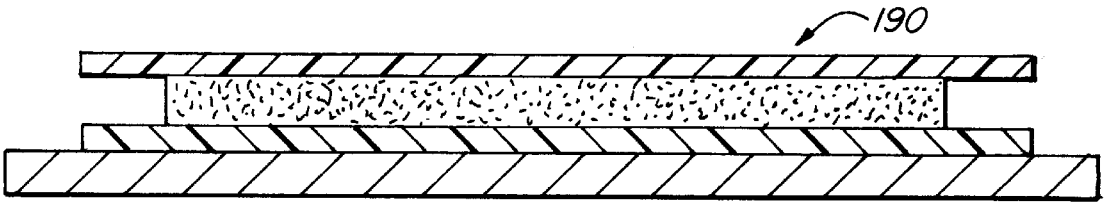
FIGS. 6–9 are assemblies for making alternate embodiments of the applique of FIG. 1.
Figure 7:
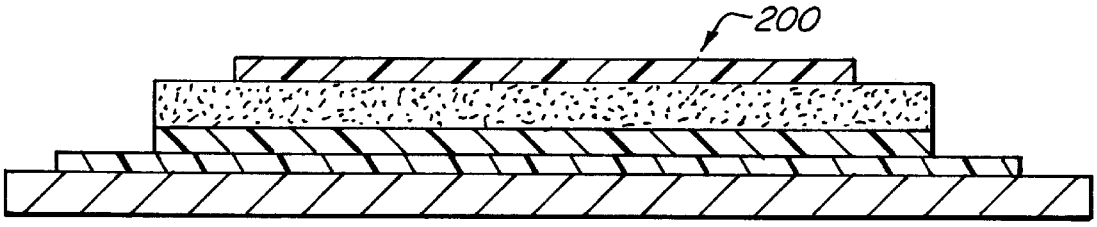
Figure 8:
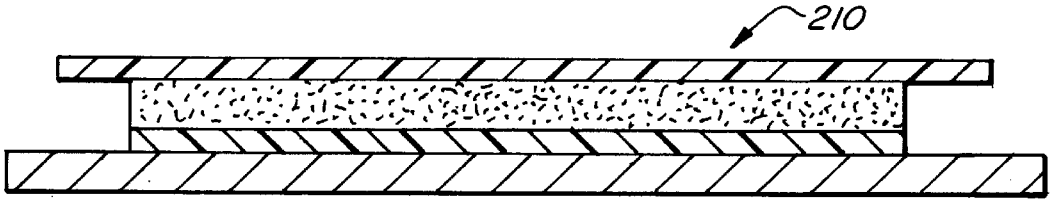
Figure 9:
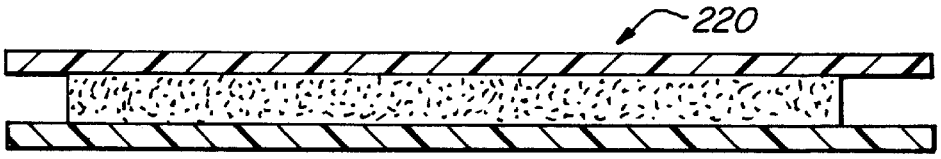

FIG. 5 shows an applique 10''' with the layers 50, 70, 80 sealed to a heat activated backing layer 110 for later application to a garment 20 and the like. It is understood that the appliques 10', and 10" can also be applied to a heat activated backing layer 110, rather than directly to the garment 20. It is also understood that applique 10''' may also include a heat activated intermediate layer 170, depending upon the manufacturing process used.

A foam layer 180 may also be used between the plush layer 50 and the vinyl backing layer 100, if any, or the garment 20, or the vinyl overlay 70, 80 and the plush layer 50 to provide a more dramatic design effect. The foam may be open or closed cell foam and may be vinyl, latex or polyurethane. Preferably, the foam layer is an open cell polyurethane or polyvinyl chloride foam.

Figure 10:
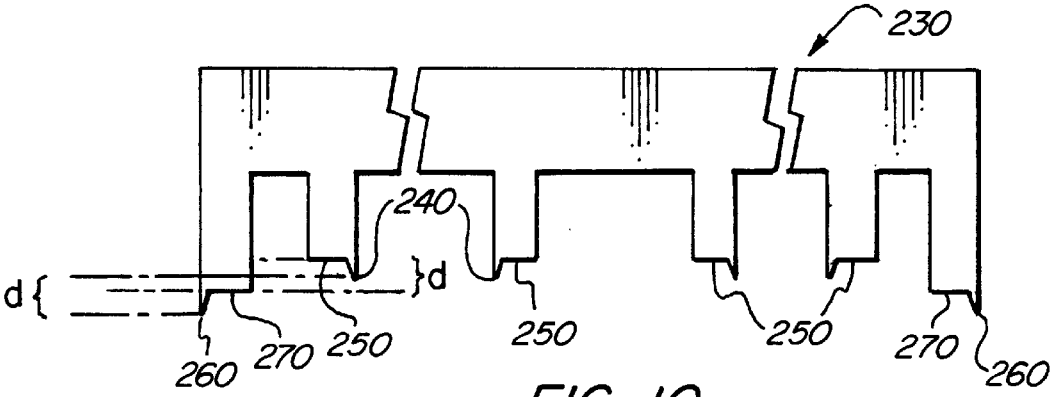
FIG. 10 is a die used for making the applique of FIG. 1.

The appliques 10, 10', 10", or 10''', and alternatives thereof, may be made by heat sealing an assembly 190, 200, 210 or 220, as shown in FIGS. 6–9 respectively, using a radio-frequency sealing die 230 having differential height cutting and sealing capability d, as shown in FIG. 10, and removing the areas of the vinyl overlay 70, 80 which are cut. It is understood that other heat sources may be used to seal the assemblies 190, 200, 210 and 220 with the disclosed differential height cutting and sealing features d. The differential height cutting and sealing features d include the die 230 having higher inner seal-cut edges 240 and a higher inner seal 250 than the lower peripheral seal-cut edge 260 and seal edge 270. These seal-cut edges 240 and 260, and seals 250 and 270 are decoratively shaped so as to provide appliques 10, 10', 10", and 10''', having the desired decoratively shaped perimeter 30 and relief pattern 40.

An alternative method for making appliques 10, 10', 10", and 10''', includes bonding the plush layer 50 to the garment 20 using a heat activated intermediate layer 170, and then welding the vinyl overlay 70, 80 to the garment with the vinyl overlay 70 encapsulating the plush layer 50.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An appliqué having a perimeter, comprising;

a plush layer having a pre-cut periphery within the perimeter;

a peripheral vinyl overlay extending along the perimeter and encapsulating the precut periphery of said plush layer, said plush layer and vinyl overlay forming a part of a relief pattern of the appliqué;

at least one vinyl overlay disposed within the precut periphery of and on the plush layer.

2. The applique according to claim 1 further comprising at least one vinyl backing layer adjacent to said plush layer opposite said vinyl overlay.

3. The applique according to claim 1 wherein said vinyl overlay further comprises decorative printing or texturing.

4. The applique according to claim 1 further comprising a heat activated intermediate layer adjacent to said plush layer.

5. The applique according to claim 1 wherein said peripheral, vinyl overlay comprises a lower peripheral seal and a higher inner seal.

6. The applique according to claim 5 wherein said peripheral, vinyl overlay further comprises a lower peripheral seal-cut edge and a higher inner seal-cut edge.

7. The applique according to claim 1 further comprising a foam layer adjacent to said plush layer.

8. The applique according to claim 1 further comprising a heat-activated backing layer adjacent to said plush layer opposite said vinyl overlay.

9. The applique according to claim 8 wherein the vinyl overlay further comprises decorative printing or texturing.

10. The appliqué according to claims 1 wherein one vinyl overlay is spaced from the peripheral vinyl overlay according to the relief pattern.

11. The appliqué according to claim 5 wherein the heat activated intermediate layer is adjacent to an inner side of the peripheral vinyl overlay facing away from the one vinyl overlay.

* * * * *